United States Patent [19]

Reed et al.

[11] 4,312,205

[45] Jan. 26, 1982

[54] PADDLE LOCK WITH ROTATABLY-MOUNTED HANDLE DISCONNECT MEMBER

[75] Inventors: James A. Reed, Brecksville; Edwin W. Davis, Medina, both of Ohio

[73] Assignee: The Eastern Company, Cleveland, Ohio

[21] Appl. No.: 108,017

[22] Filed: Dec. 28, 1979

[51] Int. Cl.[3] ..... E05B 55/10

[52] U.S. Cl. ..... 70/472; 70/149; 70/218; 70/489; 292/173; 292/DIG. 27; 292/DIG. 31

[58] Field of Search ..... 70/472, 488, 489, 149, 70/204, 218, 208, 221–224, 416; 292/167, 173, 223, 226, DIG. 27, DIG. 31, DIG. 37

[56] References Cited

U.S. PATENT DOCUMENTS

| | | | |
|---|---|---|---|
| 5,492 | 3/1948 | Pye | 292/DIG. 27 X |
| 95,507 | 10/1869 | Petre | 292/DIG. 27 X |
| 269,953 | 1/1883 | Moritz . | |
| 528,450 | 10/1894 | Swanberg . | |
| 1,751,184 | 3/1930 | Wodarra . | |
| 1,785,381 | 12/1930 | Holtzman . | |
| 1,840,062 | 1/1932 | Taylor . | |
| 1,909,210 | 5/1933 | Miller . | |
| 1,911,564 | 5/1933 | Gahagan . | |
| 1,960,410 | 5/1933 | Christensen . | |
| 1,964,066 | 6/1934 | Kuszmaul . | |
| 2,053,805 | 9/1936 | Van Note . | |
| 2,075,948 | 4/1937 | Kuszmaul . | |
| 2,117,715 | 5/1938 | Godfried . | |
| 2,274,455 | 6/1942 | Murphy . | |
| 2,322,892 | 2/1943 | Springer . | |
| 2,453,505 | 11/1948 | Fornwald | 70/149 X |
| 2,453,505 | 11/1948 | Fornwald . | |
| 2,459,029 | 1/1949 | Ingres et al. . | |
| 2,468,644 | 4/1949 | Springer . | |
| 2,582,928 | 1/1952 | Dall . | |
| 2,603,963 | 7/1952 | Allen . | |
| 2,629,618 | 2/1953 | Roethel . | |
| 2,649,321 | 8/1953 | Smith . | |
| 2,658,781 | 11/1953 | Allen . | |
| 2,700,290 | 1/1955 | Dall . | |
| 2,705,882 | 4/1955 | Craig . | |
| 2,705,884 | 4/1955 | Craig . | |
| 2,723,145 | 11/1955 | Smith . | |
| 2,728,214 | 12/1955 | Craig . | |
| 2,772,908 | 12/1956 | Craig . | |
| 2,773,716 | 12/1956 | Craig . | |
| 2,782,062 | 2/1957 | Smith . | |
| 2,877,043 | 3/1959 | Leslie . | |
| 2,955,864 | 10/1960 | Van Voorhees . | |
| 2,978,895 | 4/1961 | Heisler . | |
| 2,987,907 | 6/1961 | Cockburn et al. . | |
| 3,007,731 | 11/1961 | Roethel . | |
| 3,069,889 | 12/1962 | Johnstone et al. . | |
| 3,104,124 | 9/1963 | Beck . | |
| 3,121,580 | 2/1964 | Di Salvo et al. . | |
| 3,129,026 | 4/1964 | Gergoe et al. . | |
| 3,153,551 | 10/1964 | Sandor et al. . | |
| 3,171,677 | 3/1965 | Klove, Jr. et al. . | |
| 3,309,127 | 3/1967 | Pickles . | |
| 3,314,708 | 4/1967 | Welch . | |
| 3,386,760 | 6/1968 | Bessette . | |
| 3,394,957 | 7/1968 | Foley . | |
| 3,423,117 | 1/1969 | Klove, Jr. et al. . | |
| 3,587,259 | 6/1971 | Sandor . | |
| 3,649,061 | 3/1972 | Meyer . | |
| 3,672,713 | 6/1972 | Pickles . | |
| 3,679,251 | 7/1972 | Brockman et al. . | |
| 3,695,660 | 10/1972 | Fetters . | |
| 3,695,663 | 10/1972 | Cockburn . | |
| 3,697,105 | 10/1972 | Marx . | |
| 4,116,027 | 9/1978 | Tannery | 70/472 |
| 4,116,027 | 9/1978 | Tannery . | |
| 4,170,119 | 10/1979 | Kalis, Jr. . | |

FOREIGN PATENT DOCUMENTS

| | | |
|---|---|---|
| 135399 | 9/1947 | Australia . |
| 717308 | 2/1942 | Fed. Rep. of Germany . |

*Primary Examiner*—William E. Lyddane

*Attorney, Agent, or Firm*—Burge & Porter Co.

[57] ABSTRACT

A door lock has a flush-mountable body. A forwardly facing recess is defined by the body. A paddle-type handle is pivotally carried by the body and is movable between a nested position within the body recess and an operating position. A spring-projected slide bolt is carried on the back of the body and is movable between projected and retracted positions. A key-controlled disconnect linkage is provided for selectively connecting and disconnecting the handle and the bolt. The disconnect linkage includes a rotatably-mounted disconnect member which extends longitudinally relative to the bolt. Interengageable formations are provided on the bolt and the disconnect member. The interengageable formations are brought into and out of driving engagement by the movement of a key-operated locking member. When the disconnect linkage drivingly connects the handle and the bolt, movement of the handle from its nested position to an operating position will cause corresponding retracting movement of the bolt. When the disconnect linkage disconnects the handle from the bolt, movement of the handle is inoperative to cause retracting movement of the bolt. A feature of the disconnect linkage is that it provides the lock with a "slam" capability, meaning that when the bolt is projected, it can be slammed into latching engagement with a suitably configured strike regardless of whether the disconnect linkage is drivingly connecting or disconnecting the handle and the bolt.

53 Claims, 7 Drawing Figures

PADDLE LOCK WITH ROTATABLY-MOUNTED HANDLE DISCONNECT MEMBER

CROSS-REFERENCE TO RELATED APPLICATIONS

PADDLE LOCKS WITH HANDLE DISCONNECT FEATURES, Ser. No. 108,007 filed concurrently herewith on Dec. 28, 1979 by John V. Pastva, Jr., hereinafter "Disconnect Case I."

PADDLE LOCK WITH PIVOTALLY MOUNTED HANDLE DISCONNECT MEMBER, Ser. No. 108,007 filed concurrently herewith on Dec. 28, 1979 by Albert L. Pelcin, hereinafter "Disconnect Case II."

PADDLE LOCK WITH BOLT-CARRIED HANDLE DISCONNECT MEMBER, Ser. No. 108,010 filed concurrently herewith on Dec. 28, 1979 by John V. Pastva, Jr. and Albert L. Pelcin, hereinafter "Disconnect Case III."

PADDLE LOCK WITH TRANSLATABLY-MOUNTED HANDLE DISCONNECT MEMBER, Ser. No. 107,859 filed concurrently herewith on Dec. 28, 1979 by Edwin W. Davis, hereinafter "Disconnect Case V."

PADDLE LOCK WITH HANDLE DISCONNECT, Ser. No. 108,015 filed concurrently herewith on Dec. 28, 1979 by Jye P. Swan, John V. Pastva, Jr. and Donald J. Dignan, hereinafter "Disconnect Case VI."

PADDLE LOCK WITH GUARD-PROTECTED DISCONNECT MEMBER, Ser. No. 107,858 filed concurrently herewith on Dec. 28, 1979 by Edwin W. Davis, hereinafter "Disconnect Case VII."

FLUSH-MOUNTABLE LOCK WITH ACTUATOR DISCONNECT FEATURE, Ser. No. 108,011 filed concurrently herewith on Dec. 28, 1979 by Edwin W. Davis, hereinafter "Disconnect Case VIII."

The present application and the applications cross-referenced above have been assigned to a common entity, The Eastern Company, a corporation of Connecticut.

BACKGROUND OF THE INVENTION

1. Field of the Invention

The present invention relates generally to a door lock having a spring-projected slide bolt, a handle for retracting the bolt, and a key control for selectively permitting and preventing the handle from retracting the bolt. More particularly, the invention relates to a lock of this type including a key-controlled disconnect linkage for selectively drivingly connecting and disconnecting the handle and the bolt, whereby the handle is, at all times, freely movable between normal and operating positions, but is functional only when the key control is "unlocked" to enable the handle to retract the bolt.

While the present invention has particularly advantageous use in conjunction with flush-type door locks used on swinging doors of vehicles, industrial cabinets, electrical equipment enclosures and the like, principles of the invention are not limited in application to such uses.

2. Prior Art

Flush-type door locks including a body, a lock bolt slidably carried on the body, and an operating handle for moving the bolt relative to the body are well known. Normally the handle is in a flush or nested position when the bolt is projected. Bolt retraction is effected by pivoting the handle to an operating position. Locks of this type are well suited for use on swinging doors of vehicles such as trucks, on merchandise, tool and equipment cabinets, electrical equipment enclosures and the like.

Flush-type, paddle-handle door locks employing key-operated rotatable cams for selectively permitting and preventing unlocking movements of operating handles, and having spring-projected slide bolts, are described in U.S. Pat. No. 3,707,862, and 3,668,907 granted Jan. 2, 1973 and June 13, 1972, respectively, to John V. Pastva, Jr. An ornamental appearance employed in locks of this general type is illustrated in U.S. Design Pat. No. 230,132 issued Jan. 29, 1974 to John V. Pastva, Jr.

The provision of a handle disconnect feature in a door lock is desirable in that the presence of such a feature will lessen, if not totally eliminate, incidents of these locks being damaged by would-be intruders. Since the handles of most previously proposed door locks are restrained from moving when the locks are locked, it is common for would-be intruders to attempt to gain entry by applying excessive leverage force to the lock handles. Where handle disconnect features are provided, the lock handles may always be moved freely, but are functional to retract the lock bolts only when the locks are "unlocked." Locks having handle disconnect features can be made practically entryproof short of the application of such forces as will totally destroy the locks.

Door locks employing various types of handle disconnect systems have been proposed. Prior proposal shave, however, suffered from a variety of drawbacks including complexities of construction; failures to mount all of the operating parts of a lock on a single body member so that the resulting locks form compact, easy to install units; and, inappropriately configured parts of sizes and shapes that prohibit installation of locks embodying such proposals in conventionally configured door lock mounting openings.

3. The Cross-Referenced Disconnect Cases

The present invention and the inventions described in the several referenced Disconnect Cases represent the work products of a continuous and continuing development program which began nearly a decade ago.

The several handle disconnect systems described in the referenced Disconnect Cases were developed by co-workers operating, in some instances independently, and in other instances jointly, as is reflected in the naming of sole and joint inventors. Many of the disconnect system features claimed in separate ones of the referenced Disconnect Cases were developed substantially concurrently.

Where a claim in one of the referenced Disconnect Cases is found to be generic to a development concept utilized in another of these cases, it should be understood that care has been taken to present the generic claim in the case which describes the earliest development of a species that will support the generic claim. In this manner, a careful effort has been made to establish clear lines of demarcation among the claimed subjects matter of this and the several referenced Disconnect Cases. No two of these patents include claims of identical scope.

SUMMARY OF THE INVENTION

The present invention overcomes the foregoing and other drawbacks of the prior proposals by providing a novel and improved, reliable and durable, handleoperated door lock which includes a simple but effective key-controlled disconnect linkage for selectively drivingly connecting and disconnecting an operating handle and a spring-projected slide bolt.

A door lock embodying principles of the present invention preferably includes a support structure or body having side and back walls which cooperate to define a forwardly-facing recess. A bolt is slidably supported on the body for movement within a passage located behind the back wall. The bolt is movable between projected and retracted positions with respect to the body, and a compression coil spring biases the bolt toward its projected position. A handle is supported on the body for swinging movement between a nested position and an operating position.

A key-controlled disconnect linkage has a locking member which is movable between locked and unlocked positions. A rotatably mounted disconnect member is moved by the locking member between positions wherein the disconnect member selectively drivingly connects and disconnects the handle and the bolt. Interengageable formations are provided on the bolt and the disconnect member. The interengageable formations are brought into and out of driving engagement by the movement of the key-operated locking member. When the locking member is in its locked position, the disconnect member disconnects the handle and the bolt such that movement of the handle will cause no corresponding movement of the bolt. When the locking member is in its unlocked position, the disconnect member is operable to drivingly connect the handle and the bolt such that, when the handle is moved out of its nested position to an operating position, the bolt is retracted.

The disconnect linkage includes several improvements over previously proposed handle disconnect systems. It includes a rotatably-mounted disconnect member having an elongate central portion which extends longitudinally through the bolt mounting passage. The disconnect member has an enlarged inner end portion which is positioned in a receiving formation provided in the bolt. The inner end portion is normally engaged by a portion of the handle which also extends into the receiving formation. The disconnect member has a crank-shaped outer end region which is connected to a key-operated locking member. The locking member is operable to rotate the disconnect member to bring into and out of driving engagement a pair of interengageable formations provided on the disconnect member and on the bolt.

A feature of locks embodying the preferred practice of the present invention is that conventional lock bodies and handles may be utilized thereby giving these locks substantially the same dimensional configurations as previously proposed locks which has no handle disconnect features. Moreover, since the disconnect functions of these locks are carried out principally at shielded locations within their slide bolt housings, the locks are not significantly different in appearance from previously proposed paddle locks which had no handle disconnect features.

As will be apparent from the foregoing summary, a feature of the present invention lies in the provision of a novel and improved door lock with a key-controlled disconnect system for selectively drivingly connecting and disconnecting the handle and the bolt.

These and other features and a fuller understanding of the present invention may be had by referring to the following detailed description and claims taken in conjunction with the accompanying drawings.

DESCRIPTION OF THE PREFERRED EMBODIMENT

Figure 1:
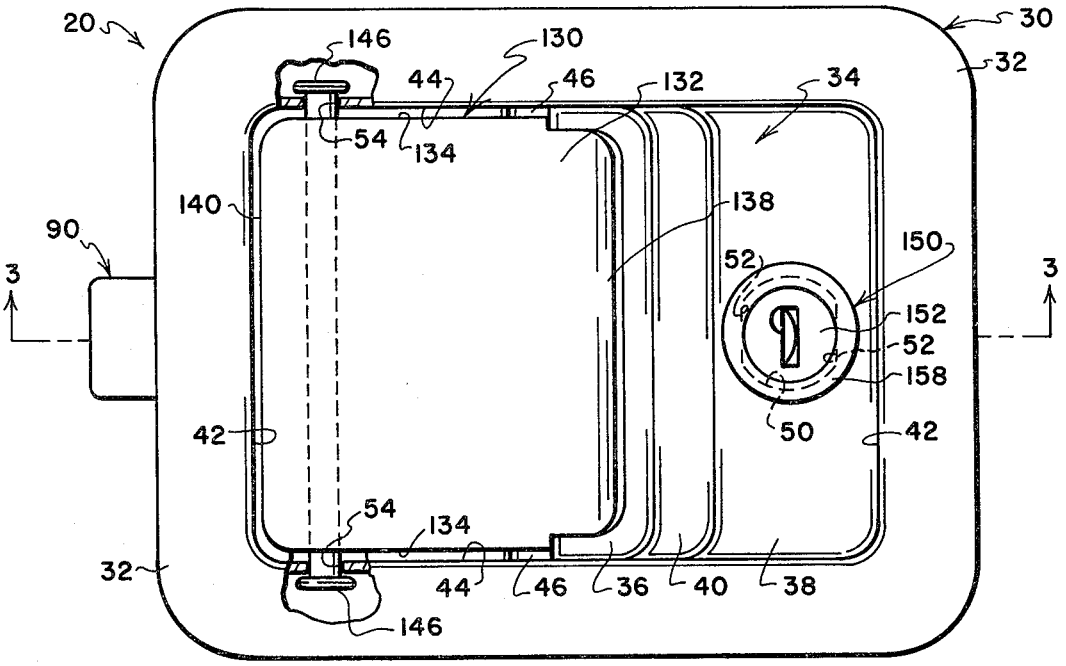
FIG. 1 is a front side elevational view of a lock embodying the preferred practice of the present invention, with portions broken away to permit underlying components to be viewed, the components of the lock being positioned in an unlocked attitude, with the handle nested and the bolt projected.
Figure 2:
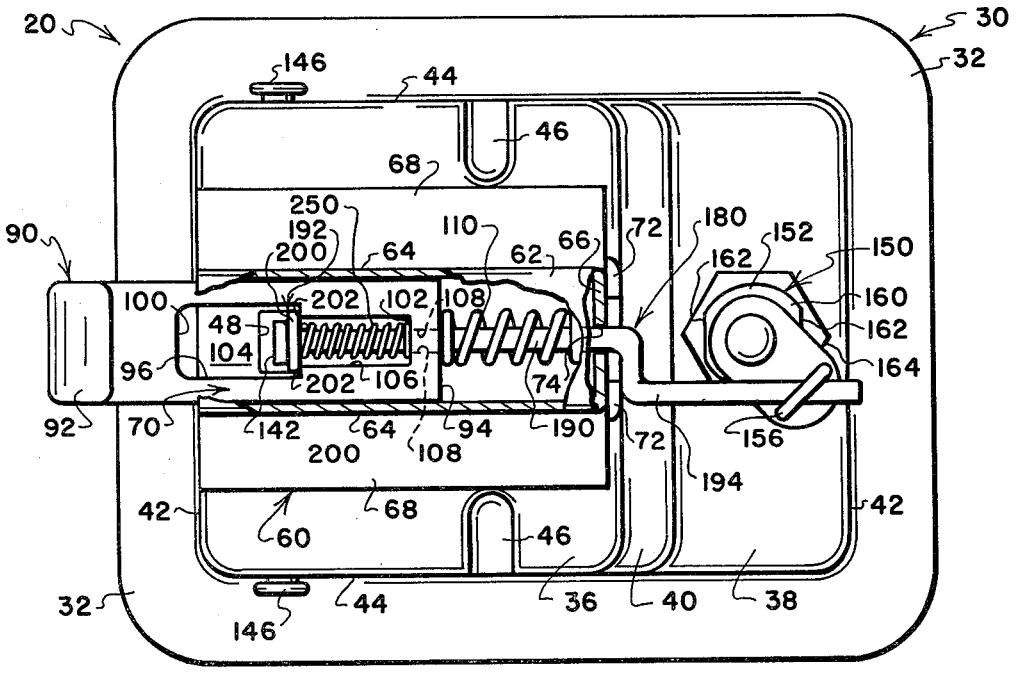
FIG. 2 is a rear side elevational view of the lock of FIG. 1 with portions broken away to permit underlying components to be viewed, with the components of the lock positioned as shown in FIG. 1.

Referring to FIGS. 1–5, a key-controlled, paddle-handle, flush-mountable lock embodying the preferred practice of the present invention is indicated generally by the numeral 20. The lock 20 is adapted to be supported on such structures as a swinging door (not shown) for relative movement therewith to bring the lock 20 into and out of juxtaposition with a suitably configured conventional strike (not shown) supported on a door frame or other structure (not shown). The manner in which locks of this general type are mounted on doors is well known to those skilled in the art. The mounting of such locks is described and illustrated in such patents as Pastva, Jr., U.S. Pat. No. 3,668,907.

In general, the lock 20 includes a recessed body 30 having a bolt housing 60 welded to the rear side of the body 30. The bolt housing 60 and the back wall of the body 30 cooperate to define an elongate passage 70. A bolt 90 is slidably carried in the passage 70 for movement between retracted and projected positions. A compression coil spring 110 biases the bolt 90 toward its projected position. A paddle handle 130 is pivotally carried on the body 30 for movement between nested and operating positions. A key control 150 and a disconnect member 180 are provided for selectively drivingly connecting and disconnecting the handle 130 and the bolt 90. A compression coil spring 250 is interposed between the bolt 90 and the disconnect member 180 for biasing the disconnect member 180 leftwardly, relative to the bolt 90, as viewed in FIG. 3, and for biasing the handle 130 toward its nested position.

The body 30 is a rectangular, pan-shaped metal stamping having a perimetrically extending flange 32 which surrounds a forwardly facing recess 34. Left and right back wall portions 36, 38 define levels of different depths in opposite end portions of the recess 34. An inclined back wall portion 40 interconnects the left and right back wall portions 36, 38. Forwardly extending end walls 42 and side walls 44 connect the back wall portions 36, 38, 40 with the flange 32.

Other features of the body 30 include a pair of stops 46 formed in the left back wall portion 36. The stops 46 project into the recess 34 at locations near the side walls 44, and are engaged by the handle 130 when the handle 130 is in its nested position. An elongate slot 48 is provided in the left back wall portion 36 at a location overlying the bolt 90. A hole 50 is formed through the right back wall portion 38. Opposite sides of the hole 50 have flat, parallel-extending surfaces 52. Aligned holes 54 are formed through the side walls 44 near their left ends.

The bolt housing 60 is a channel-shaped sheet metal stamping having a bottom wall 62, a pair of opposed side walls 64, an end wall 66, and a pair of mounting flanges 68. The flanges 68 overlie and are welded to the rear side of the left back wall portion 36.

Figure 3:
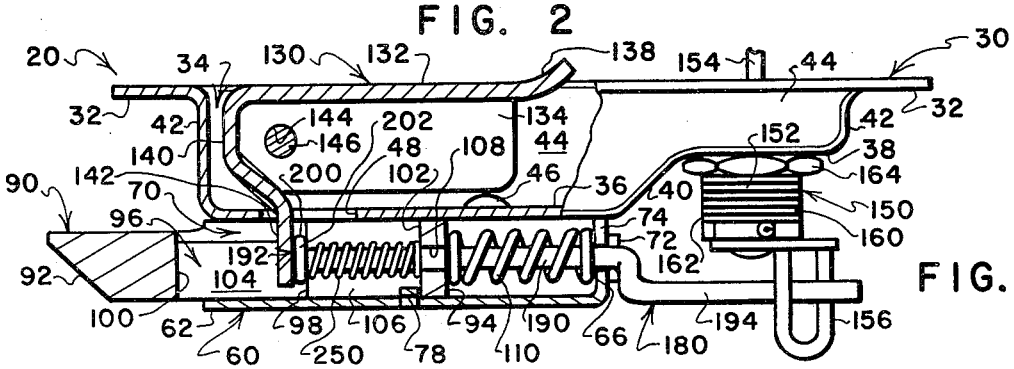
FIG. 3 is a bottom plan view of the lock of FIG. 1 with portions broken away and shown in cross-section as seen from a plane indicated by a line 3—3 in FIG. 1, with the components of the lock positioned as shown in FIG. 1.
Figure 4:
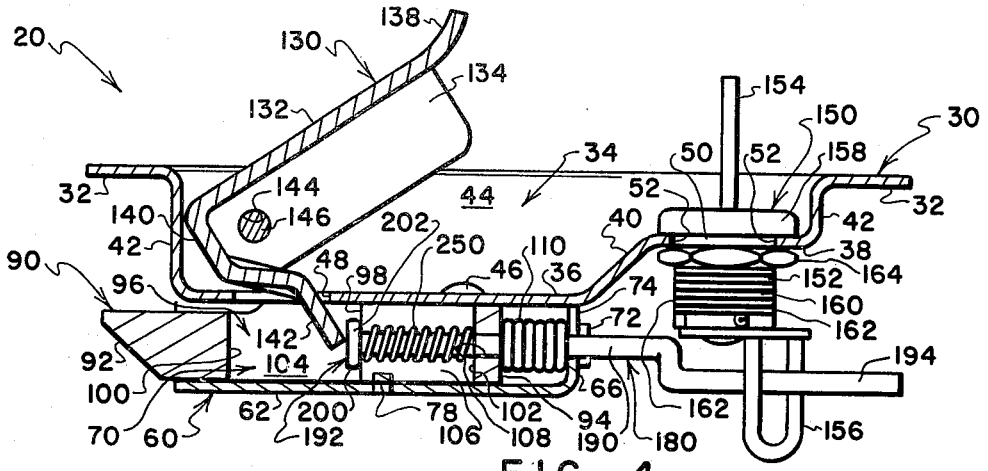
FIG. 4 is a sectional view similar to FIG. 3 with components of the lock positioned in an unlocked attitude, with the handle extended to an operating position, and with the bolt retracted.
Figure 5:
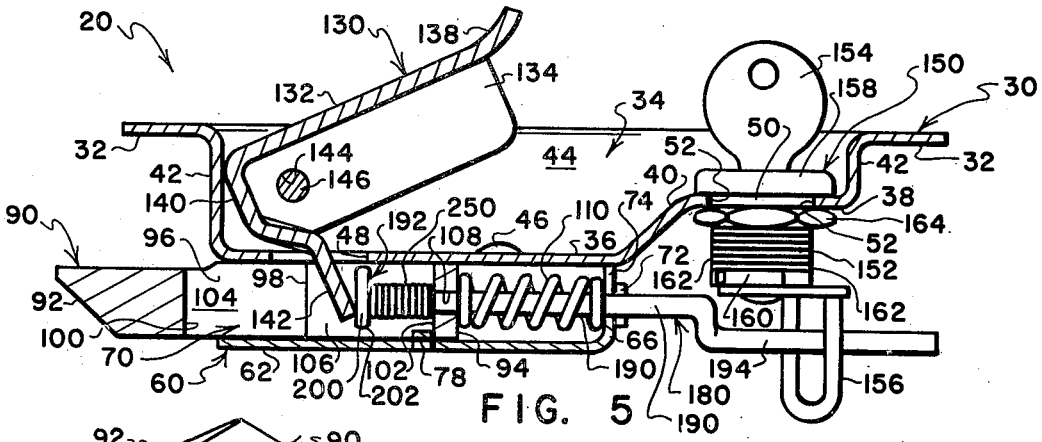
FIG. 5 is a sectional view similar to FIG. 4 with the components of the lock positioned in a locked attitude, with the handle extended to an operating position, and with the bolt nonetheless still extended.

The bolt housing 60 cooperates with the left back wall portion 36 to define the passage 70 within which the bolt 90 is guided for sliding movement. The end wall 66 is formed as an integral part of the bottom wall 62, and operates to close a majority of the area of the right end of the bolt passage 70. The side walls 64 have a pair of integrally formed locking tabs 72 which are folded to overlie the end wall 66 to reinforce the end wall 66. A slot 74 is formed in the end wall 66 and the disconnect member 180 extends through the slot 74. An inwardly extending stop formation 78 projects upwardly from the bottom wall 62, as is best seen in FIGS. 3–5. The stop formation 78 is formed as an integral part of the bottom wall 62.

Figure 6:
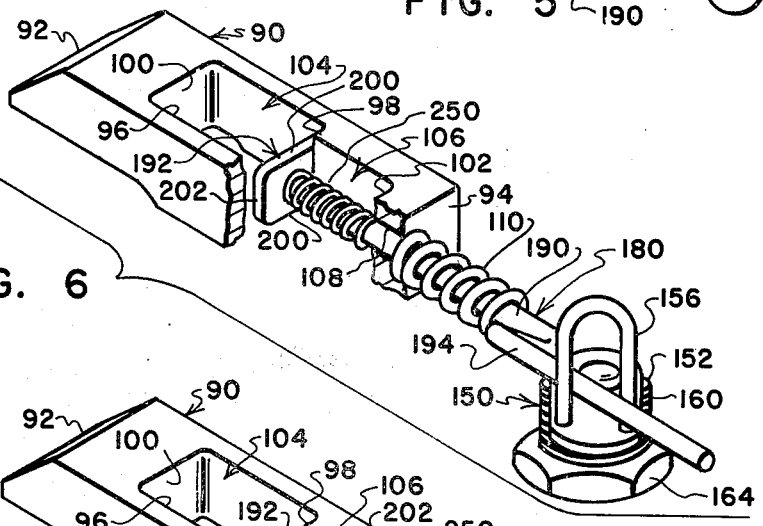
FIG. 6 is a perspective view of selected components of the lock shown in an unlocked attitude; and, FIG. 7 is a perspective view similar to FIG. 6 with the components shown in a locked attitude.
Figure 7:
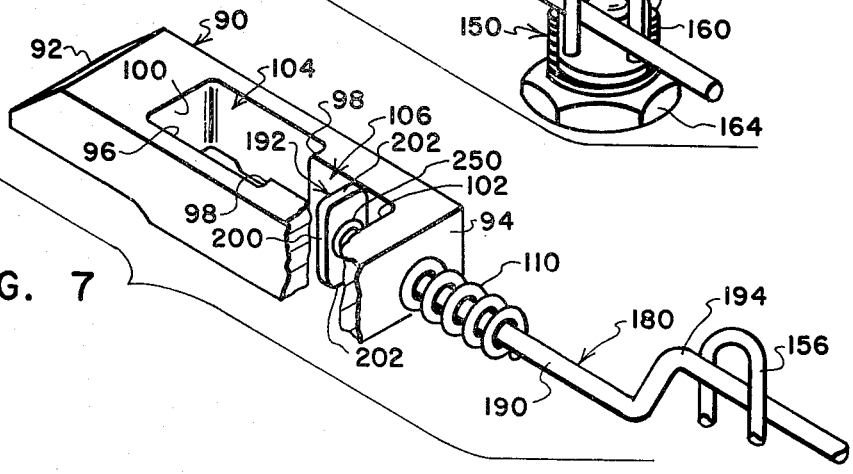

Referring to FIGS. 6 and 7, the bolt 90 is a solid metal member which can be formed by conventional casting or powder metallurgy techniques. The bolt 90 has a generally rectangular cross section which corresponds to that of the passage 70. The bolt 90 has a tapered left end 92 configured, as is conventional, to permit the bolt 90 to be retracted in response to slamming engagement with a suitably configured strike (not shown). The bolt 90 has a flat right end 94. The bolt 90 has a receiving formation which preferably takes the form of an elongate slot 96 provided in the central part of the bolt 90. The bolt slot 96 has left and right end walls 100, 102 at its opposite ends. The bolt slot 96 has left and right end regions 104, 106 which are joined by a laterally extending shoulder 98. The left end region 104 is wider in cross section than is the right end region 106. The shoulder formation 98 provides a transition between the cross sections of the end regions 104, 106. A hole 108 is formed through the right end region of the bolt 90. One end of the hole 108 opens through the slot end wall 102. The other end of the hole 108 opens through the right end 94 of the bolt 90.

The bolt 90 is movable between a projected or latching position, shown in FIGS. 1–3 and 5, and a retracted or unlatching position shown in FIG. 5. When the bolt 90 is projected, its tapered left end 92 extends beyond the left edge of the body flange 32. When the bolt 90 is retracted, its tapered left end 92 extends substantially evenly with the left edge of the body flange 32.

The compression coil spring 110 is positioned in the passage 70 and slip-fits about the disconnect member 180. The spring 110 has a left end which engages the bolt end 94, and a right end which engages the bolt housing end wall 66. The spring 110 biases the bolt 90 leftwardly toward its projected position wherein the left end 102 of the bolt slot 96 engages the stop formation 78. The spring 110 is compressed to progressively greater degrees as the bolt 90 is retracted.

The paddle handle 130 is a sheet metal stamping having a generally rectangular, substantially flat plate portion 132 and a pair of opposed, inwardly-turned side flanges 134. An outwardly-turned gripping flange 138 is provided in the right end of the handle 130, and an inwardly-turned operating flange 140 is provided at the left end. An operating arm 142 is formed as an integral projection of the operating flange 140. The handle operating arm 142 extends through the back wall slot 48 and into the bolt slot 96.

The handle 130 has aligned mounting holes 144 formed through its side flanges 134. A headed pin 146 extends through the body holes 54 and through the handle mounting holes 44 to pivotally mount the handle 130 on the body 30 at a location between the body side walls 44. The spring 250 biases the disconnect member 180 leftwardly into engagement with the operating arm 142 and, in turn, biases the handle 130 clockwise, as viewed in FIG. 3, toward a position where the handle side flanges 134 engage the bottom wall stops 46.

When the handle 130 is moved out of its nested position to an operating by pivoting it counterclockwise about the axis of the pin 146, as shown in FIGS. 4 and 5, one or the other of the springs 110, 250 will be compressed depending on whether the disconnect member 180 is in what will be termed its "connecting" position or its "disconnecting" position. In FIGS. 4 and 6 the disconnect member 180 is in its connecting position wherein it provides a driving connection between the handle 130 and the bolt 90. When the disconnect member 180 is in its connecting position, the bolt 90 is caused to retract rightwardly in the passage 70 as the handle 130 pivots out of its nested position. In FIGS. 5 and 7 the disconnect member 180 is in its disconnecting position. When the disconnect member 180 is in its disconnecting position, it provides no driving connection between the handle 130 and the bolt 90 whereby, when the handle 130 is pivoted about the axis of the pin 146, no corresponding movement of the bolt 90 takes place.

As is seen in FIGS. 3–5, the operating arm 142 is normally spaced from the left end surface 100 of the slot 96. The spacing between the slot end surface 100 and the operating arm 142 provides a lost motion connection which permits the bolt 90 to be retracted, i.e. moved rightwardly in the passage 70, without requiring corresponding pivotal movement of the handle 130. This feature is desirable because it provides the lock 20 with a capability to be "slammed" to bring the bolt 90 into latching engagement with a suitably configured strike (not shown) without causing the handle 130 to pivot out of its nested position.

The key control 150 includes a lock cylinder 152 into which a key 154 may be inserted. The key 154 is configured to cooperate with tumblers housed within the cylinder 152 to permit an eccentrically-mounted locking member 156 to be rotated between locked and unlocked positions. The locking member 156 is of U-shaped configuration, and the disconnect member 180 extends through the opening defined between the legs of the U-shaped locking member 156. The unlocked position of the locking member 156 is shown in FIGS. 1–4 and 6. The locked position of the locking member 156 is shown in FIGS. 5 and 7. The U-shaped, eccentrically-mounted locking member 156 pivots from one side of the bolt passage 70 to the other as it moves between its locked and unlocked positions.

The cylinder 152 is provided with an enlarged head 158 and a threaded body 160. A pair of flats 162 are formed on opposite sides of the threaded body 160. The cylinder 152 is positioned with its head 158 engaging the forward surface of the right body portion 38, with its body 160 extending through the hole 50, and with its flats 162 engaging the flat surfaces 52. A locknut 164 is threaded onto the body 160 to hold the cylinder 152 in place on the lock body 30.

While the key control 150 is of a conventional, commercially available type, it is selected from among various commercially available key controls which have particular operational characteristics. These operational characteristics should include key removal capability when the locking member 156 is positioned in either of its locked and unlocked positions. A further characteristic of the key control 150 is that, once the locking member 156 has been positioned in either of its locked or unlocked positions and the key 154 has been removed from the cylinder 152, the key control 150 maintains the locking member 156 in such position.

Referring to FIGS. 6 and 7, the disconnect member 180 has an elongate, cylindrical central section 190 which terminates in an enlarged left end formation 192 and a crank-like right end formation 194. The central portion 190 is slidably carried in the bolt hole 108. The left end formation 192 extends into the bolt's receiving formation 96. The right end formation extends through the U-shaped locking member 156. The U-shaped locking member 156 serves to "crank" the disconnect member 180 through a ninety degree range of rotation as the locking member 156 moves between its locked and unlocked positions.

The left end formation 192 extends radially with respect to the central portion 190. The end formation 192 has a pair of flat surfaces 200 formed on its opposite sides, and a pair of end formations 202 defined on its opposite ends. The distance between the flat surfaces 200 defines the width of the end formation 192. The distance between the end formations 202 defines the length of the end formation 192. The length of the end formation 192 is greater than its width.

When the disconnect member 180 is positioned in its disconnecting position, the flat surfaces 200 are oriented, as shown in FIG. 7, such that the left end formation 192 may be moved into the right end region 106 of the slot 96. When the disconnect member 180 is positioned in its connecting position, the end formations 202 are oriented, as shown in FIG. 6, to drivingly engage the bolt shoulder 98. Stated in another way, when the disconnect member 180 is in its connecting position, the enlarged left end 192 is prevented from moving into the right end region 106 of the slot 96.

When the locking member 156 is in its unlocked position as shown in FIGS. 1–4 and 6, the disconnect member 180 is rotated to its connecting position where, as is best seen in FIG. 6, the enlarged left end formation 192 engages the bolt shoulder 98 to provide a driving connection between the handle 130 and the bolt 90. When the disconnect member 180 is in its connecting position, pivotal movement of the handle 130 from its nested position, shown in FIG. 3, to an operating position, shown in FIG. 4, will cause the disconnect member 180 to move rightwardly carrying with it the bolt 90. Under these circumstances, movement of the handle 130 to its operating position will cause corresponding retracting movement of the bolt 90, as is illustrated in FIG. 4.

When the locking member 156 is in its locked position, as shown in FIGS. 5 and 7, the disconnect member 180 is rotated to its disconnecting position where, as is best seen in FIG. 7, the enlarged left end formation 192 is free to move into the right end region 106 of the bolt slot 96, and no driving connection is provided between the disconnect member 180 and the bolt 90. When the disconnect member 180 assumes its disconnecting position, pivotal movement of the handle 130 from its nested position to its operating position will cause the disconnect member 180 to move rightwardly without carrying with it the bolt 90. Under these circumstances, the handle 130 can be moved freely without causing any corresponding movement of the bolt 90, as is illustrated in FIG. 5.

Referring to FIGS. 3–5, the compression coil spring 250 has a left end which engages the enlarged left end formation 192 of the disconnect member 180, and a right end which engages the right end wall 102 of the bolt slot 96. By this arrangement, the spring 250 biases the disconnect member 182 leftwardly relative to the bolt 90 toward a position of engagement with the operating arm 142, and, in turn, also biases the handle 130 toward its nested position.

Referring to FIG. 3, the normal extended positions of springs 110, 250 are shown. The bolt projection spring 110 is stronger than the handle return spring 250, and therefore assures that the bolt 90 will assume its projected position whenever that is possible, despite such opposition as may be posed by the handle return spring 250. Referring to FIGS. 4 and 6, when the handle 130 is extended with the lock 20 "unlocked," the bolt projection spring 110 is compressed while the spring 250 remains substantially in its extended attitude. Referring to FIGS. 5 and 7, when the handle 130 is extended with the lock 20 "locked," the handle return spring 250 is compressed while the bolt projection spring 110 remains in its extended attitude.

While the disconnect member 180 is shown as being formed from a single piece of metal, in order to facilitate assembly of the lock 20, it may be desirable to form the disconnect member end formation 192 separately from the remainder of the member 180, and to provide these parts with a suitable means (not shown) for connecting these parts during assembly of the lock 20. If the disconnect member 180 is formed as a single piece, one of the end formations 192, 194 must be formed after the central portion 190 has been inserted through the springs 110, 250 and through the bolt hole 108.

Although the invention has been described in its preferred form with a certain degree of particularity, it is understood that the present disclosure of the preferred form is only by way of example and that numerous changes in the details of construction and the combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A door lock, comprising:

(a) a body structure;

(b) a bolt structure connected to the body structure for movement between latching and unlatching positions, the bolt structure having a connecting formation connected thereto for movement along a first path of travel relative to the body structure in response to movement of the bolt structure between its latching and unlatching positions;

(c) a handle structure connected to the body structure for movement between normal and operating positions, the handle structure having an operating formation connected thereto for movement along a second path of travel relative to the body structure in response to movement of the handle structure between its normal and operating positions;

(d) key control means connected to a selected one of the structures and having a locking member which is movable relative to the selected structure between locked and unlocked positions, the key control means being operable to selectively retain the locking member in its locked and unlocked positions;

(e) disconnect means interposed between the operating formation and the connecting formation for selectively drivingly connecting and disconnecting the operating and connecting formations to thereby selectively drivingly connect and disconnect the handle and bolt structures, the disconnect means including mounting means connecting at least a part of the disconnect means to a given one of the structures for movement relative to the given structure:

(i) along a third path of travel relative to the given structure between connecting and disconnecting positions in response to movement of the locking member between its locked and unlocked positions; and, (ii) when the part of the disconnect means is in its connecting position, along a fourth path of travel relative to the body structure in response to movement of the operating formation along the second path of travel;

(f) the disconnect means being operable:

(i) when the part of the disconnect means is in its connecting position, to drivingly connect the handle and bolt structures such that, when the handle structure is moved to its operating position, the bolt structure is caused to move to its unlatching position; and, (ii) when the part of the disconnect means is in its disconnecting position, to provide no driving connection between the handle and bolt structures, whereby the handle structure may be moved freely between its normal and operating positions without causing corresponding movement of the bolt structure; and, (g) the mounting means being operable to rotatably mount the part of the disconnect means for movement along the third path of travel relative to the given structure about a rotation axis, whereby the third path of travel is caused to take the form of an arc having the rotation axis as its center of radius.

2. The door lock of claim 1 wherein the body structure includes a first housing member having wall portions including a back wall portion which cooperate to define a forwardly-facing recess, and a second housing member rigidly connected to the first housing member and cooperating therewith to define a passage within which the bolt structure is mounted for movement.

3. The door lock of claim 1 wherein means defining a lost motion connection connects the operating formation and the bolt structure for enabling the bolt structure to be moved from its latching position to its unlatching position without causing corresponding movement of the operating formation.

4. The door lock of claim 1 wherein means defining a lost motion connection connects the disconnect means and the bolt structure for enabling the bolt structure to be moved from its latching position to its unlatching position without causing corresponding movement of the disconnect means.

5. The door lock of claim 1 wherein the connecting formation includes an abutment surface formed on the bolt structure.

6. The door lock of claim 5 wherein the abutment surface comprises a wall portion defining part of an elongate slot formed in the bolt structure.

7. The door lock of claim 1 wherein the operating formation includes an abutment surface formation on the handle structure.

8. The door lock of claim 1 wherein:

(a) the handle structure is mounted on the body structure for pivotal movement about a mounting axis; and, (b) the operating formation is connected to the handle structure for pivotal movement about the mounting axis.

9. The door lock of claim 1 wherein the key control means is mounted on the body structure.

10. The door lock of claim 1 wherein the bolt structure comprises an elongate member mounted on the body structure for sliding movement relative to the body along a linear first path of travel extending longitudinally of the elongate member.

11. The door lock of claim 1 wherein the locking member is rotatably mounted by the key-control means and carries an eccentric formation which receives a selected region of the disconnect means for drivingly interconnecting the locking member and the disconnect means.

12. The door lock of claim 11 wherein the selected region is radially offset from the part of the disconnect means and forms a crank-like structure engaged by the eccentric formation.

13. The door lock of claim 1 additionally including biasing means interposed between the body and handle structures for biasing the handle structure toward its normal position relative to the body structure.

14. The door lock of claim 1 wherein:

(a) the connecting formation is a laterally extending wall surface provided intermediate the ends of an elongate slot formed in the bolt structure, the wall surface providing a transition between slot end regions of relatively wide and relatively narrow cross section;

(b) the operating formation extends into the bolt slot and is positioned in the relatively wide slot end region when the handle is nested;

(c) the disconnect means has a driving formation which is carried by the rotatably mounted part, which extends into the bolt slot toward the operating formation, and which is movable between engaging and disengaging positions as the disconnect means part moves between its connecting and disconnecting positions, respectively;

(d) the driving formation being configured to align with the wall surface when in its engaging position and being engageable by the operating formation to provide a driving connection between the operating and connecting formations; and, (e) the driving formation being configured to not align with the wall surface when in its disengaging position to provide no driving connection between the operating and connecting formations.

15. The door lock of claim 14 wherein, when the driving formation is in its disengaging position, movement of the handle structure from its normal position to its operating position will cause the operating formation to drivingly engage the driving formation and to cause both of these engaging formations to move into the narrow slot end region without causing any corresponding movement of the bolt structure.

16. A door lock, comprising:

(a) a body structure;

(b) an elongate bolt structure connected to the body structure for movement between latching and unlatching positions, the bolt structure having a connecting formation connected thereto for movement along a first path of travel as the bolt structure moves between its latching and unlatching positions;

(c) a handle structure connected to the body structure for movement between normal and operating positions, the handle structure having an operating formation connected thereto for movement along a second path of travel as the handle structure moves between its normal and operating positions;

(d) disconnect means interposed between the connecting formation and the operating formation, a first part of the disconnect means being rotatable about an axis substantially paralleling the length of the elongate bolt structure into and out of intersection with a selected one of the first and second paths of travel as at least a portion of the disconnect means moves between connecting and disconnecting positions, the first part of the disconnect means being operable:

(i) when the portion of the disconnect means is in its connecting position, to cooperate with the connecting and operating formations to drivingly connect the handle and bolt structures such that, when the handle structure is moved to its operating position, the bolt structure is caused to move to its unlatching position; and, (ii) when the portion of the disconnect means is in its disconnecting position, to provide no driving connection between the handle and bolt structures; and, (e) key-control means connected to one of the structures and being operable to move the portion of the disconnect means between its connecting and disconnecting positions and to selectively releasably retain the portion of the disconnect means in its connecting and disconnecting positions.

17. The door lock of claim 16 wherein the operating formation is pivotally mounted on the body structure whereby the second path of travel is curved along its length.

18. The door lock of claim 16 wherein:

(a) a first abutment surface is defined on the operating formation;

(b) a second abutment surface is defined on the disconnect means; and, (c) the first and second abutment surfaces are configured to drivingly engage each other when (i) the disconnect means is positioned in its connecting position and (ii) the handle structure is moved from its normal position to its operating position.

19. The door lock of claim 16 wherein the key-control means is mounted on the body structure.

20. The door lock of claim 16 wherein the bolt structure comprises an elongate member mounted on the body structure for sliding movement relative to the body structure along a linear first path of travel extending longitudinally of the elongate member.

21. The door lock of claim 16 wherein the bolt structure is provided with a formation which is engageable by the disconnect means when (i) the disconnect means is in its connecting position and (ii) the handle structure is moved from its normal position to its operating position, the engagement between the formation and the disconnect means being operable to effect movement of the bolt structure from its latching position to its unlatching position as the handle structure is moved from its normal position to its operating position.

22. A door lock, comprising:

(a) a body structure;

(b) a bolt structure connected to the body structure for movement between latching and unlatching positions, the bolt structure having a connecting formation connected thereto for movement along a first path of travel as the bolt structure moves between its latching and unlatching positions;

(c) a handle structure connected to the body structure for movement between normal and operating positions, the handle structure having an operating formation connected thereto for movement along a second path of travel as the handle structure moves between its normal and operating positions;

(d) disconnect means interposed between the connecting formation and the operating formation, a first part of the disconnect means being movable along a third path of travel into and out of intersection with a selected one of the first and second paths of travel as at least a portion of the disconnect means moves between connecting and disconnecting positions, the first part of the disconnect means being operable:

(i) when the portion of the disconnect means is in its connecting position, to cooperate with the connecting and operating formations to drivingly connect the handle and bolt structures such that, when the handle structure is moved to its operating position, the bolt structure is caused to move to its unlatching position; and, (ii) when the portion of the disconnect means is in its disconnecting position, to provide no driving connection between the handle and bolt structures;

(e) key-control means connected to one of the structures and being operable to move the portion of the disconnect means between its connecting and disconnecting positions and to selectively releasably retain the portion of the disconnect means in its connecting and disconnecting positions;

(f) the connecting formation being a laterally extending wall surface provided intermediate the ends of an elongate slot formed in the bolt structure, the wall surface providing a transition between slot end regions of relatively wide and relatively narrow cross section;

(g) the operating formation extending into the bolt slot and being positioned in the relatively wide slot end region when the handle is nested;

(h) the disconnect means having a driving formation which is carried by the rotatably mounted part, which extends into the bolt slot forward the operating formation, and which is movable between engaging and disengaging positions as the disconnect means part moves between its connecting and disconnecting positions, respectively;

(i) the driving formation being configured to align with the wall surface when in its engaging position and being engageable by the operating formation to provide a driving connection between the operating and connecting formations; and, (j) the driving formation being configured to not align with the wall surface when in its disengaging position to provide no driving connection between the operating and connecting formations.

23. The door lock of claim 22 wherein, when the driving formation is in its disengaging position, movement of the handle structure from its normal position to its operating position will cause the operating formation to drivingly engage the driving formation and to cause both of these engaging formations to move into the narrow slot end region without causing any corresponding movement of the bolt structure.

24. A door lock, comprising:

(a) a body structure;

(b) a bolt structure connected to the body structure for movement between latching and unlatching positions;

(c) a handle structure connected to the body structure for movement between normal and operating positions;

(d) an operating formation connected to the handle structure for movement in a first plane along a first path of travel in response to movement of the handle structure between its normal and operating positions;

(e) disconnect means interposed between the operating formation and the bolt structure, and including a disconnect member, the disconnect member being movable within the first plane along the first path of travel between connecting and disconnecting positions, the disconnect means being operable:

(i) when the disconnect member is in its connecting position, to cooperate with the operating formation and with the bolt structure to drivingly connect the handle and bolt structures such that, when the handle structure is moved to its operating position, the bolt structure is caused to move to its unlatching position; and, (ii) when the disconnect member is in its disconnecting position, to provide no driving connection between the handle and bolt structures;

(f) key-control means connected to one of the structures and having a locking member movable between locked and unlocked positions, the key-control means being operable:

(i) when the locking member is in its unlocked position, to position the disconnect member in its connecting position; and, (ii) when the locking member is in its locked position, to position the disconnect member in its disconnecting position; and, (g) the disconnect means additionally including guide means for:

(i) mounting at least a part of the disconnect member for translatory movement in the first plane as the handle structure moves between its normal and operating positions while the locking member is in its locked position; and, (ii) mounting at least a segment of the disconnect member for rotary movement within the first plane as the locking member moves between its locked and unlocked positions.

25. The door lock of claim 24 wherein means defining a lost motion connection connects the disconnect means and the bolt structure for enabling the bolt structure to be moved from its latching position to its unlatching position without causing correspondingly movement of the disconnect means.

26. The door lock of claim 24 wherein the guide means includes a hole formed through the bolt structure, within which at least a part of the disconnect member is slidably carried for said translatory movement.

27. The door lock of claim 24 wherein:

(a) the operating formation is pivotally movable about a first axis of rotation as the handle structure moves between its normal and operating positions;

(b) the guide means journals at least a segment of the disconnect member for rotation about a second axis as the locking member moves between its locked and unlocked positions; and, (c) the first axis of rotation extends in a plane which is substantially perpendicular to a plane within which the second axis extends.

28. The door lock of claim 24 wherein:

(a) a first abutment surface is defined on the operating formation;

(b) a second abutment surface is defined on the disconnect member; and, (c) the first and second abutment surfaces are configured to drivingly engage each other when, while the disconnect member is positioned in its connecting position, the handle structure is moved from its normal position to its operating position.

29. The door lock of claim 24 wherein a selected one of the locking member and the disconnect member is provided with an elongate formation cooperates with an interfitting formation provided on the other of these members, the elongate formation and the interfitting formation being configured to permit said translatory movement of the disconnect member without transmitting forces to the locking member.

30. The door lock of claim 29 wherein the elongate formation is provided on the disconnect member, and the opening is provided in the locking member.

31. The door lock of claim 24 wherein:

(a) the bolt structure is provided with a formation which is engageable by the disconnect member when the handle structure is moved from its normal position to its operating position while the disconnect member is in its connecting position; and, (b) the engagement between the bolt structure formation and the disconnect member is operable to effect movement of the bolt structure from its latching position to its unlatching position as the handle structure is moved from its normal position to its operating position.

32. The door lock of claim 31 wherein:

(a) the bolt structure formation includes a transversely extending shoulder which provides a transition between relatively wide and relatively narrow end regions of a slot formed in the bolt structure; and, (b) the disconnect member is provided with an abutment formation which is movable into and out of alignment with the shoulder as the disconnect member is rotated between its connecting and disconnecting positions.

33. The door lock of claim 24 wherein a first biasing means functions to bias the bolt structure toward its latching position, and a second biasing means functions to bias the handle structure toward its normal position.

34. The door lock of claim 33 wherein the first biasing means is interposed between the body and bolt structures.

35. The door lock of claim 33 wherein the second biasing means is interposed between the bolt structure and the disconnect member.

36. The door lock of claim 24 wherein:

(a) the bolt structure has a receiving formation formed therein defining an abutment surface; and, (b) the body structure carries a stop formation which engages the abutment surface when the bolt structure is in its latching position.

37. A door lock comprising:

(a) a body structure;

(b) an elongate bolt structure connected to the body structure for movement along a first path of travel between latching and unlatching positions;

(c) a handle structure connected to the body structure for movement between normal and operating positions;

(d) an operating formation connected to the handle structure for movement in response to movement of the handle structure between its normal and operating positions, the movement of the operating formation following a second path of travel;

(e) disconnect means interposed between the operating formation and the bolt structure, and including a disconnect member which is rotatable about an axis substantially paralleling the length of the elongate bolt structure between connecting and disconnecting positions, the disconnect means being operable:

(i) when the disconnect member is in its connecting position to intersect the first and second paths of travel to drivingly connect the handle and bolt structures such that, when the handle structure is moved to its operating position, the bolt structure is caused to move to its unlatching position; and, (ii) when the disconnect member is in its disconnecting position, to provide no driving connection between the handle and bolt structures;

(f) key-control means connected to one of the structures and including a locking member movable between locked and unlocked positions, the key-control means being operable:

(i) when the locking member is in its unlocked position, to position the disconnect member in its connecting position; and, (ii) when the locking member is in its locked position, to position the disconnect member in its disconnecting position; and, (g) guide means mounting the disconnect member for rotation about said axis as the disconnect member moves between its connecting and disconnecting positions.

38. The door lock of claim 37 wherein:

(a) biasing means operates to bias the disconnect member into engagement with the operating formation; and, (b) the guide means mounts the disconnect member for translation along a third path of travel as the operating formation moves along the first path of travel.

39. The door lock of claim 38 wherein the first, second and third paths of travel extend, at least in part, along a common path portion.

40. A door lock comprising:

(a) a body structure;

(b) a bolt structure connected to the body structure for movement between latching and unlatching positions, the bolt structure carrying a first abutment formation, the first abutment formation being movable along a first path of travel as the bolt structure moves between its latching and unlatching positions;

(c) a handle structure connected to the body structure for movement between normal and operating positions, the handle structure carrying a second abutment formation, the second abutment formation being movable along a second path of travel as the handle structure moves between its normal and operating positions;

(d) disconnect means interposed between the handle and bolt structures, and including a disconnect member which is movable between connecting and disconnecting positions, the disconnect means being operable:

(iI) when the disconnect member is in its connecting position to intersect the first and second paths of travel to engage the first and second abutment formations to drivingly connect the handle and bolt structures such that, when the handle structure is moved to its operating position, the bolt structure is caused to move to its unlatching position; and, (ii) when the disconnect member is in its disconnecting position, to disengage at least one of the first and second abutment formations to provide no driving connection between the handle and bolt structures;

(f) key-control means connected to one of the structures and including a locking member movable between locked and unlocked positions, the key-control means being operable:

(i) when the locking member is in its unlocked position, to position the disconnect member in its connecting position; and, (ii) when the locking member is in its locked position, to position the disconnect member in its disconnecting position; and, (g) guide means mounting the disconnect member for rotation as the disconnect member moves between its connecting and disconnecting positions.

41. The door lock of claim 40 additionally including biasing means operates to bias the disconnect member into engagement with a selected one of the first and secod abutment formations.

42. The door lock of claim 40 wherein the guide means mounts the disconnect member for translation along a third path of travel as the selected abutment formation moves along its respective path of travel.

43. The door lock of claim 40 wherein the first, second and third paths of travel extend at least in part, along a common path portion.

44. The door lock of claim 40 wherein the first abutment formation includes a shoulder found on the bolt structure, and the disconnect member has an enlarged end formation which is rotated into and out of alignment with the shoulder as the disconnect member is moved between its connecting and disconnecting positions.

45. A flush-mountable door lock, comprising:

(a) a body structure having side and back walls which cooperate to define a forwardly-facing recess, and having an opening formed through the body structure;

(b) an elongate bolt structure movably connected to the body structure, the bolt structure being movable relative to the body structure along a linear path of travel between latching and unlatching positions;

(c) a handle structure mounted on the body structure and being movable between a nested position wherein the handle structure is nested within the recess, and an operating position;

(d) key-control means connected to one of the structures and including a locking member movable between locked and unlocked positions;

(e) an operating formation connected to the other of the structures and extending through the back wall opening and into the receiving formation of the bolt structure;

(f) disconnect means interposed between key-control means and the operating formation, the disconnect means including a disconnect member which is movable between a connecting position wherein it is operable to drivingly interconnect the handle and bolt structures such that when the handle structure is moved out of its nested position, the bolt structure is caused to retract, and a disconnecting position wherein no driving connection is provided between the handle and bolt structures; and, (g) guide means mounting the disconnect member for rotation about an axis of rotation as the disconnect member moves between its connecting and disconnecting positions, the axis of rotation extending substantially parallel to the linear path of travel followed by the bolt structure in moving between its latching and unlatching positions.

46. The door lock of claim 45 wherein the axis of rotation and the linear path extend, at least in part, along a common path portion.

47. The door lock of claim 45 wherein the guide means includes a hole formed through the bolt structure and journaling a part of the disconnect member.

48. The door lock of claim 45 wherein:

(a) the guide means mounts the disconnect member for translation along said axis of rotation; and, (b) the disconnect member carries an abutment formation which is rotatable into and out of alignment with corresponding abutment formation provided on a selected one of the operating formation and the bolt structure as the disconnect member moves between its connecting and disconnecting positions.

49. The door lock of claim 48 additionally including biasing means biasing the disconnect member into driving engagement with the other of the operating formation and the bolt structure.

50. The door lock of claim 45 wherein:

(a) the body structure includes a bolt housing which slidably mounts the bolt for movement along its linear path of travel;

(b) a first biasing means is interposed between the body and bolt structures for biasing the bolt structure toward its latching position;

(c) the handle structure is connected to the body structure for pivotal movement about a handle pivot axis;

(d) the key-control means is mounted on the body structure near one end of the bolt housing;

(e) the locking member is carried by the key-control means for pivotal movement abut a locking member pivot axis;

(f) the operating formation is rigidly connected to the handle structure for movement therewith about the handle pivot axis;

(g) the disconnect member includes an elongate member which is journaled by the guide means for rotation about a disconnect member rotation axis; and, (h) the handle pivot axis, the locking member pivot axis, and the disconnect member rotation axis extend in three substantially mutually perpendicular directions.

51. The door lock of claim 50 wherein the disconnect member rotation axis coincides with the linear path of travel followed by the bolt structure in moving between its latching and unlatching positions.

52. The door lock of claim 51 wherein the locking member pivot axis intersects the disconnect member rotation axis at a position near one end of the bolt housing.

53. The door lock of claim 45 wherein a selected one of the disconnect member and the locking member has a crank-like formation, and the other of the disconnect member and the locking member is operable to drivingly interconnect with the crank formation such that, when the locking member is pivoted between its locked and unlocked positions, the disconnect member is caused to be correspondingly pivoted between its connecting and disconnecting positions.

* * * * *

UNITED STATES PATENT AND TRADEMARK OFFICE

CERTIFICATE OF CORRECTION

PATENT NO. : 4,312,205
DATED : January 26, 1982
INVENTOR(S) : James A. Reed and Edwin W. Davis It is certified that error appears in the above-identified patent and that said Letters Patent are hereby corrected as shown below:

Col. 1, line 13, delete "108,007" and substitute --108,010--

Col. 1, line 17, delete "108,010" and substitute --107,859--

Col. 1, line 23, delete "107,859" and substitute --108,015--

Col. 1, line 27, delete "108,015" and substitute --108,016--

Col. 2, line 31, delete "proposal" and substitute --proposals--

Col. 2, line 32, delete "shave" and substitute --have--

Col. 3, line 55, delete "has" and substitute --had--

Col. 6, line 26, after "operating" insert --position--.

Signed and Sealed this

*Twenty-ninth* Day of *June 1982*

[SEAL]

*Attest:*

GERALD J. MOSSINGHOFF

*Attesting Officer*

*Commissioner of Patents and Trademarks*